US008092264B2

(12) United States Patent
Kinoshita et al.

(10) Patent No.: US 8,092,264 B2
(45) Date of Patent: Jan. 10, 2012

(54) MARINE VESSEL

(75) Inventors: Yoshimasa Kinoshita, Shizuoka (JP); Wataru Ikeya, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 240 days.

(21) Appl. No.: 12/567,949

(22) Filed: Sep. 28, 2009

(65) Prior Publication Data

US 2010/0227516 A1 Sep. 9, 2010

Related U.S. Application Data

(63) Continuation-in-part of application No. 12/424,733, filed on Apr. 16, 2009, now abandoned.

(30) Foreign Application Priority Data

Mar. 6, 2009 (JP) ..... 2009-052846

(51) Int. Cl.
*B63H 21/22* (2006.01)

(52) U.S. Cl. ..... 440/1; 440/87

(58) Field of Classification Search ..... 440/1, 84, 440/87, 2, 3; 701/21; 123/342, 396, 399, 123/400

See application file for complete search history.

(56) References Cited

U.S. PATENT DOCUMENTS

| | | | | |
|---|---|---|---|---|
| 6,776,676 | B2 * | 8/2004 | Tanaka et al. | 440/87 |
| 6,886,529 | B2 * | 5/2005 | Suzuki et al. | 123/342 |
| 7,124,014 | B1 | 10/2006 | Ishida et al. | |
| 7,201,620 | B2 * | 4/2007 | Kinoshita et al. | 440/1 |
| 2006/0235602 | A1 | 10/2006 | Ishida et al. | |

FOREIGN PATENT DOCUMENTS

| | | | |
|---|---|---|---|
| JP | 2002-180861 | A | 6/2002 |
| JP | 2006-299856 | A | 11/2006 |

OTHER PUBLICATIONS

Kinoshita et al.; "Boat"; U.S. Appl. No. 12/424,733, filed Apr. 16, 2009.

* cited by examiner

*Primary Examiner* — Lars A Olson
(74) *Attorney, Agent, or Firm* — Keating & Bennett, LLP

(57) ABSTRACT

A marine vessel includes a hull, a propulsion device arranged to propel the hull by a driving force of an engine that has a throttle valve arranged to be electrically controlled so as to open and close, an operation lever arranged to be operated by a marine vessel operator to adjust a throttle opening degree of the throttle valve and arranged to hold an operation position, a fine adjustment switch arranged to be operated by the marine vessel operator to increase or decrease the throttle opening degree to finely adjust the throttle opening degree that has been adjusted by the operation lever, and a control unit arranged to adjust the throttle opening degree based on an operation amount of the operation lever and an operation state of the fine adjustment switch.

18 Claims, 7 Drawing Sheets

MARINE VESSEL

CROSS-REFERENCE TO RELATED APPLICATION

This application is a Continuation-In-Part of U.S. patent application Ser. No. 12/424,733 filed on Apr. 16, 2009, currently pending.

BACKGROUND OF THE INVENTION

1. Field of the Invention

The present invention relates to a marine vessel, which includes a propulsion device that propels a hull by a driving force of an engine having a throttle valve.

2. Description of the Related Art

U.S. Patent Application Publication No. 2006/0235602 A1 discloses an electronic throttle control device applicable to an engine of a water jet propulsion watercraft or an outboard motor. The electronic throttle control device includes a plurality of characteristic conversion coefficient maps for computing target throttle opening degree command values from an accelerator operation amount. The plurality of characteristic conversion coefficient maps include a map for ordinary output and a map for low output for inexperienced operators, etc. These maps can be used alternately by operation of an engine characteristic changeover switch.

Japanese Unexamined Patent Application Publication No. 2002-180861 discloses a personal watercraft that includes a cruise control function. The cruise control function in this prior art is a function that automatically adjusts a throttle opening degree so as to maintain a constant traveling speed or a constant engine speed. The personal watercraft also includes a throttle lever supported in a swingable manner on a handle bar. Also, a cruise control operation switch is provided at a rear portion of a lever holder that holds the throttle lever. To use the cruise control function, a marine vessel operator presses the cruise control operation switch in a state where the throttle lever is operated. Then, the engine speed at the point at which the cruise control operation switch is pressed is then stored and thereafter, the throttle opening degree is adjusted automatically so as to maintain the stored engine speed.

A pedal type accelerator is described in U.S. Patent Application Publication No. 2006/0235602 A1. The pedal type accelerator is arranged to be return ordinarily to an idle position by a spring force. The throttle lever in Japanese Unexamined Patent Application Publication No. 2002-180861 is also arranged to return to an idle position by a spring force.

SUMMARY OF THE INVENTION

The inventors of the preferred embodiments of the present invention described and claimed in the present application conducted an extensive study and research regarding a marine vessel, such as the one described above but different in the structure of throttle opening degree adjustment, and in doing so, discovered and first recognized new unique challenges and problems as described in greater detail below.

That is, among marine vessels, there are those in which an operation position of an operation lever for adjusting a throttle opening degree is held. However, the operation position is not held in either the accelerator in U.S. Patent Application Publication No. 2006/0235602 A1 or the throttle lever in Japanese Unexamined Patent Application Publication No. 2002-180861. The prior art devices described in these documents are thus not suited for a marine vessel that includes an operation lever of the type with which the operation position is held.

For example, there are cases where a small-scale marine vessel, which includes an operation position holding type operation lever, is used for an application of traveling while pulling a wakeboard. In this case, the small-scale marine vessel is preferably made to travel at a constant speed. However, even if an operation amount of the operation lever is held constant, the small-scale marine vessel cannot be made to travel at a constant speed because the speed of the small-scale marine vessel changes according to operation circumstances as represented by strengths and directions of waves and wind. Further, if the small-scale marine vessel is turned, the traveling speed decreases due to increased resistance against the hull. Thus, in order to travel at a constant speed, a marine vessel operator must finely adjust the operation lever frequently according to changes of the speed of the small-scale marine vessel. However, according to a study by the present inventors, it was discovered that the operation position holding type operation lever is not necessarily suited for frequent fine adjustment of the throttle opening degree. That is, for example, it was discovered that there are cases where the marine vessel operator becomes tired due to the operation of frequently adjusting the operation lever during traveling at a constant speed.

Thus, depending on the circumstances, the operation lever is not necessarily an optimal interface for throttle opening degree adjustment. The present inventors thus arrived at resolving the above problems by providing another throttle operation system separately from the operation position holding type operation lever.

The prior art of U.S. Patent Application Publication No. 2006/0235602 A1 includes the accelerator and the engine characteristic changeover switch. However, the engine characteristic changeover switch cannot be used for the purpose of fine output adjustment because it is a switch for switching between the ordinary output characteristic and the low output characteristic. Fine adjustment of the engine output must thus be performed mainly by accelerator operation. The engine characteristic changeover switch thus does not provide a separate throttle operation system instead of the accelerator. Further, the accelerator in U.S. Patent Application Publication No. 2006/0235602 A1 does not correspond to being an operation position holding type operation lever. Fine output adjustment by accelerator operation can be performed readily and a problem such as that described above does thus not exist.

With the prior art of Japanese Unexamined Patent Application Publication No. 2002-180861, it is possible to maintain constant the traveling speed of a small-scale hull by cruise control. However, while cruise control is being performed, the engine speed or the traveling speed is adjusted regardless of the operation amount of the throttle lever. Linearity (correlation) between the operation amount of the throttle lever and the throttle opening degree is thus lost. Thus, even if the marine vessel operator operates the throttle lever with an intention to accelerate or decelerate, neither acceleration nor deceleration is performed until the cruise control is canceled. There is thus a problem that the behavior of the hull does not follow the operation of the throttle lever and this causes an uncomfortable feeling for the marine vessel operator. Moreover, as mentioned above, the throttle lever of this prior art is not an operation position holding type operation member. Thus, as in the case of U.S. Patent Application Publication No. 2006/0235602 A1, fine adjustment of the engine output can be performed readily by operation of the throttle lever, and the above-described problem in the marine vessel that includes the operation position holding type operation lever does not exist. Also, the cruise control operation switch does not provide an operation system for fine adjustment of the engine output.

In order to overcome the previously unrecognized and unsolved problems described above, a preferred embodiment of the present invention provides a marine vessel including a hull, a propulsion device arranged to propel the hull by a driving force of an engine that has a throttle valve capable of being electrically controlled to open and close, an operation lever arranged to be operated by a marine vessel operator for adjustment of a throttle opening degree of the throttle valve and arranged to hold the operation position, a fine adjustment switch arranged to be operated by the marine vessel operator to increase or decrease the throttle opening degree, which has been adjusted by the operation of the operation lever, to finely adjust the throttle opening degree that has been adjusted by the operation lever, and a control unit arranged to adjust the throttle opening degree based on an operation amount of the operation lever and an operation state of the fine adjustment switch.

By this arrangement, the throttle opening degree can be adjusted by the operation of the operation position holding type operation lever, and the throttle opening degree that has been adjusted by the operation lever can be finely adjusted by the operation of the fine adjustment switch. A plurality of operation systems arranged to adjust the throttle opening degree are thus provided. The operation position of the operation lever is held, and the throttle opening degree can thus be finely adjusted readily by the fine adjustment switch without having to operate the operation lever. That is, the marine vessel operator can adjust the throttle opening degree even by operation of just one of either the operation lever or the fine adjustment switch. Thus, by selectively using an appropriate operation system among the operation lever and the fine adjustment switch according to traveling circumstances, adjustment of the throttle opening degree can be performed readily. That is, the operation lever and the fine adjustment switch differ in operation modes, and the operation for throttle opening degree adjustment is thus facilitated by selective use according to the traveling circumstances of the marine vessel.

For example, in a case where traveling at a constant marine vessel speed is desired, when the marine vessel speed changes constantly due to waves, wind, etc., operation by the fine adjustment switch may be performed. That is, the marine vessel operator can increase or decrease the speed by the fine adjustment switch while holding constant the operation amount of the operation lever. In circumstances where fine adjustment of the throttle opening degree should be repeated, operation of a switch (the fine adjustment switch) is easier than frequent operation of the operation lever. Thus, for example, in cases of traveling at a constant speed, tiring of the marine vessel operator can be minimized and prevented because an operation load of the marine vessel operator can be lightened.

Also, a correlation between the operation amount of the operation lever and the throttle opening degree is always maintained because the throttle opening degree is adjusted based on the operation amount of the operation lever and the operation state of the fine adjustment switch. Thus, if the marine vessel operator operates the operation lever to accelerate or decelerate after the throttle opening degree has been finely adjusted by the fine adjustment switch, the throttle opening degree changes accordingly. Thus, the marine vessel operator does not experience any uncomfortable feeling. The throttle opening degree can also be adjusted by operating both the operation lever and the fine adjustment switch.

Preferably, the fine adjustment switch includes an up switch portion arranged to be operated by the marine vessel operator to increase the throttle opening degree that has been adjusted by the operation of the operation lever; and a down switch portion arranged to be operated by the marine vessel operator to decrease the throttle opening degree that has been adjusted by the operation of the operation lever. In this case, the control unit may preferably be arranged to increase the throttle opening degree according to the operation amount of the up switch portion when the up switch portion is operated, and to decrease the throttle opening degree according to the operation amount of the down switch portion when the down switch portion is operated. By this arrangement, the marine vessel operator can readily perform fine adjustment by increasing and decreasing the throttle opening degree by operating the up switch portion and for the down switch portion of the fine adjustment switch.

The "operation amount" may be a number of times of operation of a switch portion, or a continuous operation time of the switch portion, or an operation force applied to the switch portion.

Preferably, the marine vessel further includes a storage unit arranged to store reference information, expressing a correspondence relationship between the operation amount of the operation lever and a reference setting value of the throttle opening degree, first fine adjustment information defining a throttle opening degree setting value higher than the reference setting value corresponding to the operation amount of the operation lever, and second fine adjustment information defining a throttle opening degree setting value lower than the reference setting value corresponding to the operation amount of the operation lever. In this case, the control unit may preferably be arranged to select the reference information, the first fine adjustment information, or the second fine adjustment information according to the operation of the up switch portion or the down switch portion, and set the throttle opening degree based on the operation amount of the operation lever and the selected information. In addition, preferably, the control unit is arranged to select the first fine adjustment information in response to the operation of the up switch portion when the reference information is being selected, and to select the second fine adjustment information in response to the operation of the down switch portion when the reference information is being selected.

By this arrangement, the throttle opening degree can be finely adjusted without having to operate the operation lever. That is, when the marine vessel is traveling at a constant speed with the throttle opening degree being kept constant using the reference information, the traveling speed may decrease due to the influence of waves, etc. In such a case, the throttle opening degree can be increased by operating the up switch portion to change the information from the reference information to the first fine adjustment information. The traveling speed that has decreased can thereby be returned readily to the original speed without having to operate the operation lever. Likewise, when the marine vessel is traveling at a constant speed with the throttle opening degree being kept constant using the reference information, the traveling speed may increase depending on the circumstances. In such a case, the throttle opening degree can be decreased by operating the down switch portion to change the information from the reference information to the second fine adjustment information. The traveling speed that has increased can thereby be readily returned to the original speed without having to operate the operation lever. Also, the control unit adjusts the throttle opening degree based on the operation amount of the operation lever and the selected information (the reference information, the first fine adjustment information, or the second fine adjustment information). The correlation of the operation amount of the operation lever and the throttle opening degree is thus maintained regardless of which information is selected. That is, when the operation lever is operated, the throttle opening degree follows this and changes accordingly. Thus, no uncomfortable feeling is experienced by the marine vessel operator.

Preferably, the first fine adjustment information includes a plurality of first sub information defined such that a degree of increase of the throttle opening degree setting value with respect to the reference setting value increases in a stepwise manner, and the second fine adjustment information includes a plurality of second sub information defined such that a degree of decrease of the throttle opening degree setting value with respect to the reference setting value increases in a stepwise manner. By this arrangement, the marine vessel operator can use the fine adjustment switch to select either the stepwise-set first sub information or the stepwise-set second sub information. Fine adjustment of the speed (fine adjustment of the throttle opening degree) can thereby be performed more finely with respect to the reference state that is in accordance with the reference information. Also, the throttle opening degree can be changed in a continuous manner by operation of the operation lever, and the throttle opening degree can be changed in a stepwise manner by operation of the fine adjustment switch. That is, the manner of adjustment of the throttle opening degree can be switched between two types. The throttle opening degree can thereby be changed appropriately according to the traveling circumstances of the marine vessel, and the throttle opening degree adjustment operation is made even easier.

Preferably, the plurality of first sub information include a plurality of information that are defined such that throttle opening degree setting values corresponding to the same operation amount of the operation lever increase in a stepwise manner at a substantially constant increment, and the plurality of second sub information include a plurality of information that are defined such that throttle opening degree setting values corresponding to the same operation amount of the operation lever decrease in a stepwise manner at a substantially constant decrement that is smaller than the increment. By this arrangement, a difference in an amount of change of hull speed between the case where the up switch portion is operated and the case where the down switch portion is operated (difference between a degree of increase and a degree of decrease of the speed) can be lessened. An uncomfortable feeling for the marine vessel operator can thereby be minimized. That is, cases of increasing and decreasing the throttle opening degree by just the same amount shall now be considered. Resistance due to water is always applied to the hull. The decrement of the hull speed when the throttle opening degree is decreased is thus greater than the increment of the hull speed when the throttle opening degree is increased. It is thus preferable to make the increment of the throttle opening degree (the increment of the first sub information) greater than the decrement (decrement of the second sub information). The difference between the increment and the decrement of the speed with respect to the reference state corresponding to the reference information can thereby be made small. Consequently, the marine vessel operator can perform speed adjustment by the fine adjustment switch (fine adjustment of the throttle opening degree) readily and easily.

Preferably, the reference information, the plurality of first sub information, and the plurality of second sub information form an information set with which the throttle opening degree setting values corresponding to the same operation amount of the operation lever differ in a stepwise manner, and the control unit is arranged to select information that differs from the currently selected information by one step when the fine adjustment switch is operated once. More specifically, the control unit is arranged to select information with which the throttle opening degree setting value is one step greater than the currently selected information when the up switch portion is operated, and to select information with which the throttle opening degree setting value is one step less than the currently selected information when the down switch portion is operated.

Preferably, the control unit is arranged to select information that differs from the currently selected information by one step also when the fine adjustment switch is operated once and the operation of the fine adjustment switch is maintained for not less than a predetermined time. In other words, regardless of the duration of the operation of the fine adjustment switch, only a one-step change of information is performed when the fine adjustment switch is operated once. By this arrangement, the hull speed can be prevented from increasing or decreasing excessively contrary to the intention of the marine vessel operator when the fine adjustment switch is pressed continuously for not less than the predetermined time.

Preferably, the control unit is arranged to perform control to adjust the throttle opening degree based on the operation state of the fine adjustment switch in addition to the operation amount of operation lever when the operation amount of the operation lever becomes not less than a predetermined first threshold. The first threshold may, for example, be set according to a speed range in which traveling at a constant speed is desired. Fine adjustment of the throttle opening degree by the fine adjustment switch can thereby be made effective in the speed range corresponding to the operation amount of not less than the first threshold to facilitate traveling at constant speed. Before the operation amount of the operation lever reaches the first threshold, the fine adjustment of the throttle opening degree by the fine adjustment switch can be made ineffective to prevent step-like changes of the throttle opening degree. In a low throttle opening degree range, the change of engine output with respect to the change of throttle opening degree is comparatively large. Thus, by preventing the step-like change of the throttle opening degree in the low throttle opening degree range, the behavior of the marine vessel can be stabilized. Thus, uncomfortable feelings are not experienced by an operator or crew member due to the change of throttle opening degree.

Preferably, the first threshold corresponds to a throttle opening degree of transition from a state in which the hull travels in a manner of plowing through water to a planing state in which the hull travels in a manner of riding on a water surface. The planing state refers to a state where the hull planes along the water surface with a stem side hull bottom not contacting the water surface. A marine vessel capable of traveling in such a planing state is called a watercraft. An example of a watercraft is a small-scale marine vessel having a water jet propulsion device or an outboard motor as a power source. A small-scale marine vessel refers to a marine vessel with a total tonnage of less than 20 tons. However, even if the total tonnage of a marine vessel is not less than 20 tons, if the marine vessel has a length of less than 20 meters, it is included among small-scale marine vessels. A small-scale marine vessel to which a preferred embodiment of the present invention is applied preferably is that which is used mainly for sports or recreation, that is, a small-scale marine vessel primarily used for leisure, for example. Such a marine vessel may be referred to as a sport boat, a pleasure boat, etc. This type of small-scale marine vessel ordinarily has a structure such that marine vessel maneuvering is performed by a single person.

For example, in a case where a wakeboard is pulled by a watercraft at a constant speed, the watercraft travels in the planing state. Thus, by setting the first threshold as described above, the throttle opening degree adjustment by the fine adjustment switch can be performed when pulling the wakeboard at a constant speed by the watercraft. The operation load of the marine vessel operator can thereby be lightened, and the tiring of the marine vessel operator can thus be prevented.

Preferably, in this case, the control unit is arranged to perform control of adjusting the throttle opening degree based on the operation state of the fine adjustment switch in addition to the operation amount of operation lever when the operation amount of the operation lever becomes not less than the first threshold and the engine speed becomes not less than the rotational speed at which the state in which the hull travels in the manner of plowing through water transitions to the planing state in which the hull travels in the manner of riding on the water surface. By this arrangement, the throttle opening degree adjustment by operation of the fine adjustment switch can be started upon confirming the transition of the hull into the planing state by the engine speed in addition to the operation amount of the operation lever. Control based on the fine adjustment switch can thereby be started more reliably after transition of the hull into the planing state.

Preferably, the control unit is arranged to stop control by the fine adjustment switch when, in a state where control by the fine adjustment switch is being performed, the operation amount of the operation lever falls below a second threshold less than the first threshold. That is, the throttle opening degree adjustment by the fine adjustment switch is made effective by the operation amount of the operation lever becoming not less than the first threshold. Thereafter, the control based on the operation of the fine adjustment switch is not stopped unless the operation amount of the operation lever is reduced to the second threshold that is less than the first threshold. The control based on the operation of the fine adjustment switch is thus prevented from stopping immediately after the control is started.

Preferably, in this case, a width of throttle opening degree adjustment by the fine adjustment switch decreases as the operation amount of the operation lever approaches the second threshold from the first threshold, and at the second threshold, the width of throttle opening degree adjustment by the fine adjustment switch becomes substantially zero. By this arrangement, the width of adjustment by the fine adjustment switch becomes substantially zero at a timing at which the control by the fine adjustment switch stops (when the operation amount of the operation lever is the second threshold). The throttle opening degree can thereby be prevented from changing suddenly when the control based on the operation of the fine adjustment switch is stopped.

Preferably, the a maximum width of throttle opening degree adjustment by the operation of the fine adjustment switch is set in advance, and the control unit is arranged to adjust the throttle opening degree within the maximum adjustment width when the fine adjustment switch is operated. By this arrangement, any increase or decrease of the throttle opening degree can be restricted even when the fine adjustment switch malfunctions or is operated erroneously.

Preferably, the larger the operation amount of the operation lever becomes, the larger the width of throttle opening degree adjustment by the operation of the fine adjustment switch is set. By this arrangement, the throttle opening degree can be changed largely by the operation of the fine adjustment switch when the operation amount of the operation lever is large. Oppositely, the throttle opening degree can be changed minutely by the operation of the fine adjustment switch when the operation amount of the operation lever is small. The throttle opening degree can thereby be adjusted finely by the fine adjustment switch by a magnitude that is in accordance with the operation amount of the operation lever. In the low throttle opening degree range, the change of engine output with respect to the change of throttle opening degree is comparatively large. Thus, by preventing the change of throttle opening degree in the low throttle opening degree range, the behavior of the marine vessel can be stabilized. Thus, uncomfortable feelings of crew members are not caused by the change of throttle opening degree. On the other hand, in a high throttle opening degree range, the change of engine output with respect to the change of throttle opening degree is comparatively small. Thus, by making the width of change of throttle opening degree large in the high throttle opening degree range, an adequate propulsive force change can be obtained.

Preferably, the fine adjustment switch is provided near the operation lever. By this arrangement, the marine vessel operator can operate the fine adjustment switch without having to move from a position of operating the operation lever because the fine adjustment switch and the operation lever are disposed at positions close to each other.

Preferably, a first notification unit arranged to notify the marine vessel operator of the operation state of the fine adjustment switch, is further included. By this arrangement, the marine vessel operator can readily recognize the operation state of the fine adjustment switch by the first notification unit.

The first notification unit may, for example, notify (for example, display) the marine vessel operator of a number of steps from the reference information to a currently selected information.

Preferably, a second notification unit arranged to notify the marine vessel operator of that the fine adjustment switch is operated, is further included. By this arrangement, when the marine vessel operator operates the fine adjustment switch, the operator can confirm by the notification from the second notification unit that the operation of the fine adjustment switch has been accepted.

Other elements, features, steps, characteristics and advantages of the present invention will become more apparent from the following detailed description of the present preferred embodiment with reference to the attached drawings.

DETAILED DESCRIPTION OF THE PREFERRED EMBODIMENTS

Figure 1:
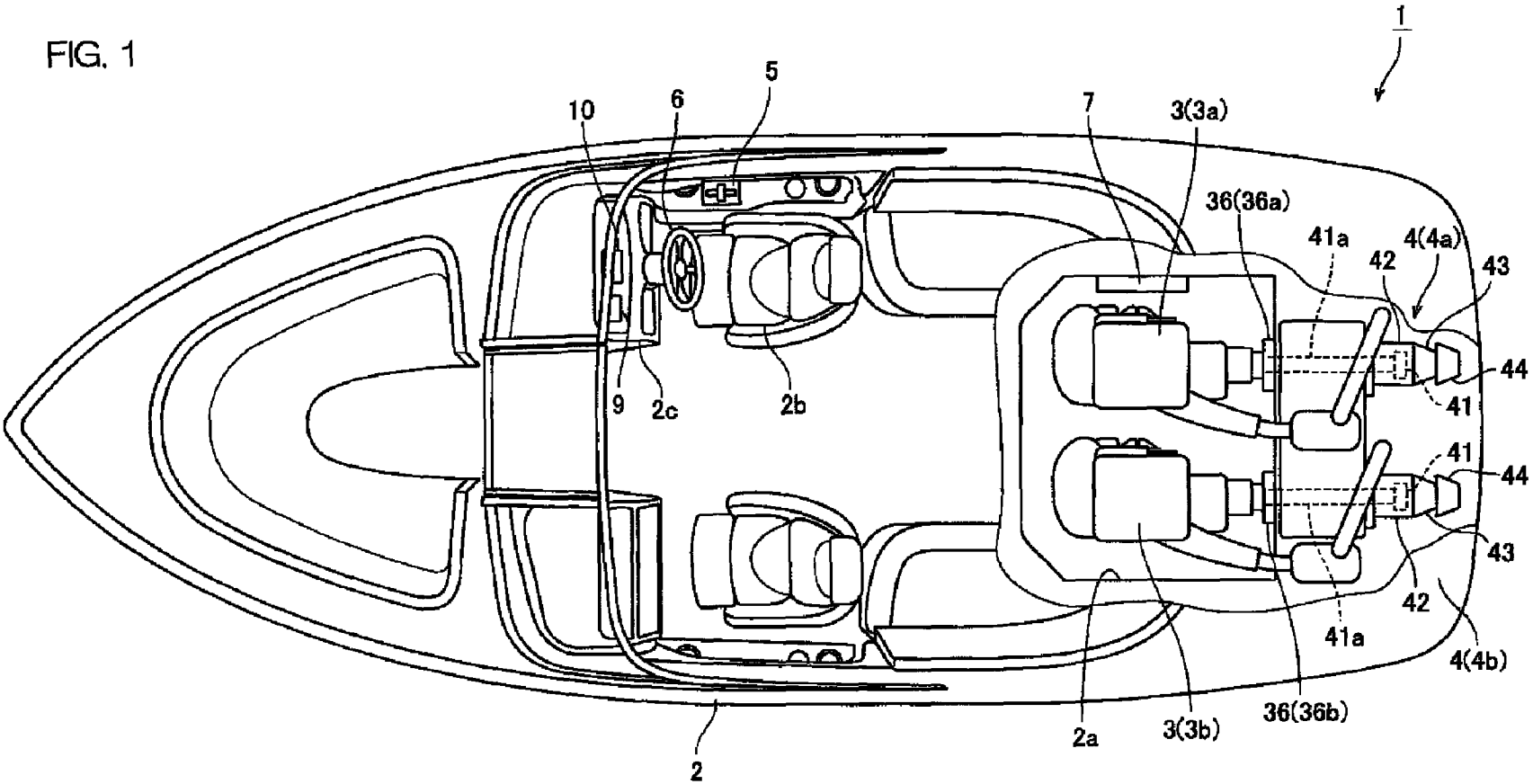
FIG. 1 is a plan view of a structure of a boat according to a preferred embodiment of the present invention.

FIG. 1 is a plan view of a structure of a boat 1 according to a preferred embodiment of the present invention. The boat 1 is preferably a pleasure boat and is just one example of a "marine vessel" according to a preferred embodiment of the present invention.

The pleasure boat 1 preferably includes a hull 2, two engines 3 (a right engine 3*a* and a left engine 3*b*), and two jet propulsion devices 4 (a right jet propulsion device 4*a* and a left jet propulsion device 4*b*). The two engines 3 and the two jet propulsion devices 4 are attached to a rear portion of the hull 2. The engines 3 are housed inside an engine room 2*a* provided in an interior of the rear portion of the hull 2. The right jet propulsion device 4*a* and the left jet propulsion device 4*b* are driven by the right engine 3*a* and the left engine 3*b*, respectively. A hull ECU 7, which performs electrical control of the pleasure boat 1, is disposed inside the engine room 2*a*. Each of the jet propulsion devices 4 is an example of a "propulsion device" according to a preferred embodiment of the present invention.

The hull 2 includes an operator's seat 2*b*, on which a marine vessel operator sits. Operation levers 5 arranged to be operated by the marine vessel operator to adjust throttle opening degrees of the engines 3, are disposed at a side of the operator's seat 2*b*. Also, a handle 6, which is arranged to be operated by the marine vessel operator to change a heading direction of the hull 2, is installed in front of the operator's seat 2*b*. Further, a dashboard 2*c* is disposed in front of the operator's seat 2*b*. A buzzer unit 9 and a display unit 10 are disposed on the dashboard 2*c*. The buzzer unit 9 and the display unit 10 are examples of a "second notification unit" and a "first notification unit," respectively, according to a preferred embodiment of the present invention.

Each jet propulsion device 4 includes an impeller 41, an impeller housing 42, a nozzle 43, and a deflector 44. The impeller 42 is attached to an impeller shaft 41*a*. The impeller shaft 41*a* is rotated by rotation of the engine 3. The impeller 41 is disposed in an interior of an impeller housing 42. A nozzle 43 is provided at a rear of the impeller housing 42. Further, a deflector 44 is disposed at a rear of the nozzle 43. The deflector 44 is arranged to be capable of swinging to the right and left.

An intake opening (not shown) is formed below the hull 2. A water jetting path, extending from the intake opening to the nozzle 43 via the impeller housing 42, is formed. By rotation of the impeller 41, water below a water surface is sucked in via the intake opening and is jetted rearward from the nozzle 43. The hull 2 is propelled by a propulsive force due to the jet jetted from the nozzle 43. The deflector 44 converts the rearward-jetted jet of water to left and right directions.

Figure 2:
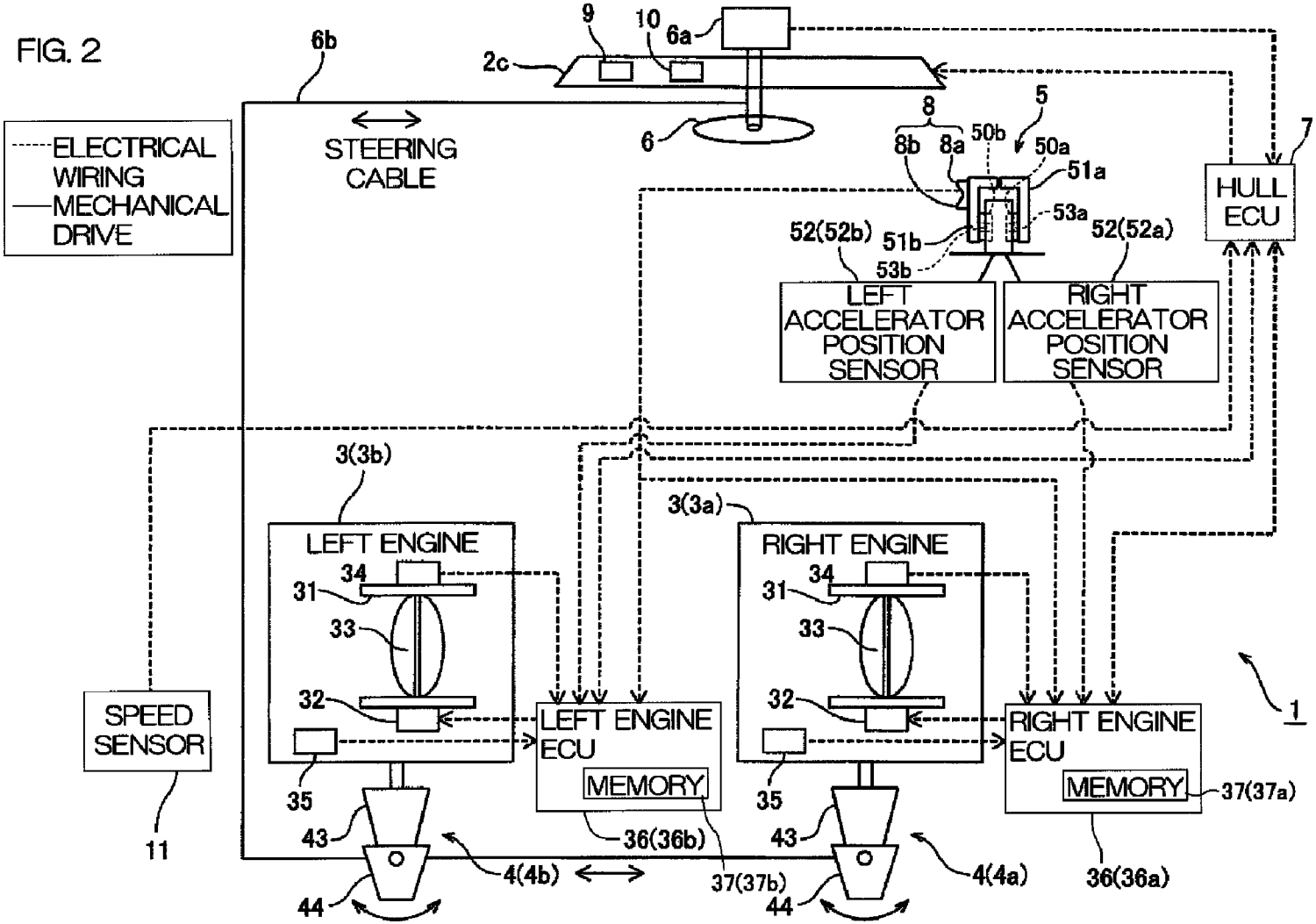
FIG. 2 is a block diagram mainly of an electrical arrangement of the boat.

FIG. 2 is a block diagram mainly of an electrical arrangement of the pleasure boat 1. The operation levers 5 are of an operation position holding type and include two operation levers 5 (a right operation lever 51*a* and a left operation lever 51*b*), respectively corresponding to the right engine 3*a* and the left engine 3*b*. The right operation lever 51*a* and the left operation lever 51*b* are arranged to be rotatable independently of each other. More specifically, rotating shafts 53*a* and 53*b* of respective base ends of the right operation lever 51*a* and the left operation lever 51*b* are rotatably supported by a main body 50. In the main body 50, the rotating shafts 52*a* and 52*b* are respectively held by holding structures 50*a* and 50*b* in a rotatable manner and in a manner such that a rotation position is held by friction. Such holding structures 50*a* and 50*b* may be arranged, for example, to hold the operation positions of the operation lever by physical frictional forces between a link structure (not shown) incorporated in the main body 50 and the rotating shafts 53*a* and 53*b*.

The marine vessel operator can perform acceleration operation (adjustment of throttle opening degree) of the right engine 3*a* by rotating the right operation lever 51*a*. Also, by rotating the left operation lever 51*b*, acceleration operation of the left engine 3*b* can be performed. In addition, each of the right operation lever 51*a* and the left operation lever 51*b* is an example of an "operation lever" according to a preferred embodiment of the present invention.

Specifically, arrangements are made such that the throttle opening degrees of the engines 3 increase in correspondence to operation amounts of the operation levers 5. Accelerator position sensors 52 (a right accelerator position sensor 52*a* and a left accelerator position sensor 52*b*) are coupled to the operation levers 5. The right accelerator position sensor 52*a* corresponds to the right operation lever 51*a* and detects a rotation angle (operation position) of the right operation lever 51*a*. The left accelerator position sensor 52*b* corresponds to the left operation lever 51*b* and detects a rotation angle (operation position) of the left operation lever 51*b*. Arrangements are made such that the throttle opening degrees of the engines 3 (right engine 3*a* and left engine 3*b*) are controlled based on the detection result of the right accelerator position sensor 52*a* and the left accelerator position sensor 52*b*.

The handle 6 is provided for changing the directions of the propulsive forces generated by the jet propulsion devices 4 (right jet propulsion device 4*a* and left jet propulsion device 4*b*). A handle angle sensor 6*a* arranged to detect a rotation angle of the handle 6 is coupled to the handle 6. An output signal of the handle angle sensor 6*a* is input into the hull ECU 7. A steering cable 6*b* is connected to the handle 6. The steering cable 6*b* is connected to the deflectors 44 of the jet propulsion devices 4. When the marine vessel operator operates the handle 6, the operation force is transmitted by the steering cable 6*b*, and the deflectors 44 are thereby rotated. The directions of the propulsive forces generated by the jet propulsion devices 4 can thereby be changed. The deflector 44 of the right jet propulsion device 4*a* and the deflector 44 of the left jet propulsion device 4*b* are connected to each other by the steering cable 6*b*. The deflector 44 of the right jet propulsion device 4*a* and the deflector 44 of the left jet propulsion device 4*b* are thus rotated by the same angle by the operation of the handle 6.

Each engine 3 is an internal combustion engine that generates a driving force by combustion of a mixed gas of air and fuel. The engine 3 includes a throttle valve 33. The throttle valve 33 is disposed in a supply path 31 for supplying air into a mixed gas combustion chamber (not shown), and is arranged to be displaceable by the driving force of an actuator 32 such as an electromotive motor to any position between a fully closed state (0% opening) and a fully open state (100% opening). The supply path 31 can be opened and closed by the throttle valve 33. The driving force of the engine 3 can be adjusted by adjusting a supply amount of air by adjusting the opening of the throttle valve 33 (throttle opening degree). The opening of the throttle valve 33 is detected by a throttle position sensor 34. Also, rotational speeds of the engines 3 are detected by engine speed sensors 35. Output signals of the engine speed sensors 35 are input into engine ECUs 36 (right engine ECU 36*a* and left engine ECU 36*b*). The engine ECUs 36 are connected via a communication line to the hull ECU 7 and perform information communication with the hull ECU 7. Each of the engine ECUs 36 is an example of a "control unit" according to a preferred embodiment of the present invention.

Also, ignition timings, fuel injection amounts, etc., of the engines 3 (right engine 3*a* and left engine 3*b*) are electrically controlled by the engine ECUs 36 (right engine 36*a* and left engine ECU 36*b*). In particular, the engine ECUs 36 perform drive control of the throttle actuators 32 based on the signals from the accelerator position sensors 52 (right accelerator position sensor 52*a* and left accelerator position sensor 52*b*). For this drive control, the output signals of the right accelerator position sensor 52*a* and the right throttle position sensor 34*a* are input into the right engine ECU 36*a*. Also, the output signals of the left accelerator position sensor 52*b* and the left throttle position sensor 34*b* are input into the left engine ECU 36*b*.

Specifically, characteristic information (throttle opening degree characteristic information), which defines a correspondence relationship between the operation amounts of the operation levers 5 and opening degree setting values (throttle opening degree setting values) of throttle valves 33, are stored in memories 37 (37*a*, 37*b*) inside the engine ECUs 36. Each engine ECU 36 references the signal from the accelerator position sensor 52 (operation amount of the operation lever 5) and the characteristic information stored in the memory 37. The engine ECU 36 reads the throttle opening degree setting value corresponding to the operation amount of the operation lever 5 from the memory 37. The engine ECU 36 is programmed to drive and control the actuator 32 such that the throttle opening degree detected by the throttle position sensor 34 becomes equal to the throttle opening degree setting value that has been read. Each memory 37 is an example of a "storage unit" according to a preferred embodiment of the present invention.

A fine adjustment switch 8 is attached to the operation lever 5. The fine adjustment switch 8 is arranged to be operated by the marine vessel operator for the purpose of switching the characteristic information. The fine adjustment switch 8 includes an up switch portion 8*a* and a down switch portion 8*b*. An operation signal of the fine adjustment switch 8 is provided to the engine ECU 36. When the up switch portion 8*a* is operated or pressed, the engine ECU 36 switches the characteristic information such that the throttle opening degree setting value corresponding to the operation amount of the operation lever 5 increases in a stepwise manner. Also, when the down switch portion 8*b* is operated or pressed, the engine ECU 36 switches the characteristic information such that the throttle opening degree setting value corresponding to the operation amount of the operation lever 5 decreases in a stepwise manner.

A speed sensor 11 that detects the speed of the hull 2 is attached to the hull 2. A detection value of the speed sensor 11 is input into the hull ECU 7.

Figure 3:
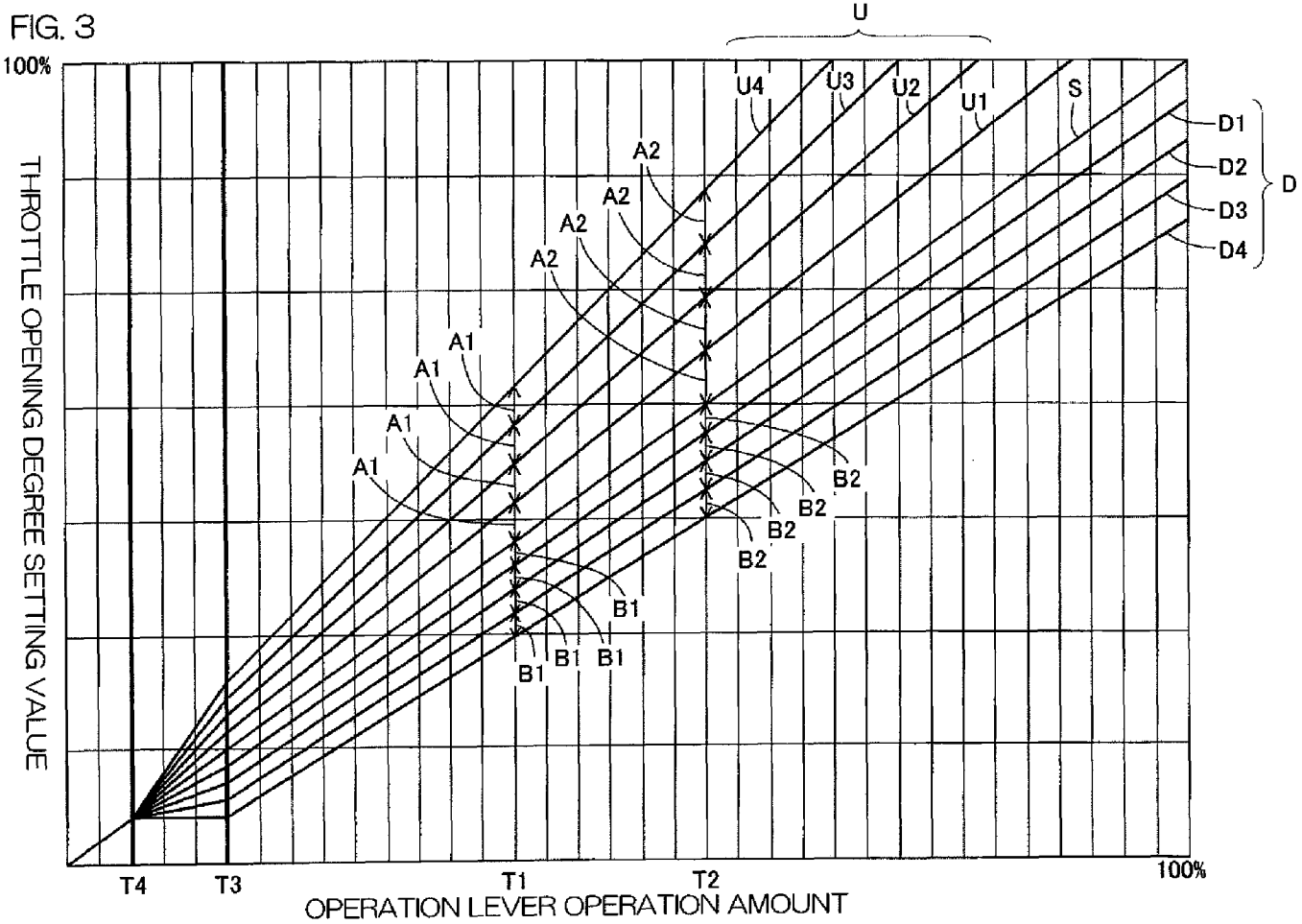
FIG. 3 is a diagram of characteristic information stored in a memory of an engine ECU of the boat.

FIG. 3 is a diagram of the characteristic information (throttle opening degree characteristic information) stored in the memory 37 of the engine ECU 36. The characteristic information may be stored in the memory 37, for example, in the form of a map that expresses the correspondence relationship of the operation amount of the operation lever 5 and the throttle opening degree setting value. In the present preferred embodiment, the characteristic information stored in the memory 37 of the engine ECU 36 includes reference characteristic information S, acceleration fine adjustment characteristic information U (U1 to U4) and deceleration fine adjustment characteristic information D (D1 to D4). The reference characteristic information S associates the operation amount of the operation lever 5 with a reference setting value of the throttle opening degree. If the fine adjustment switch 8 is not operated at all after the engine 3 is started, the reference characteristic information S is selected as initial characteristic information (default characteristic information).

The acceleration fine adjustment characteristic information U associates the operation amount of the operation lever 5 with throttle opening degree setting values that are higher than the reference setting value. In the present preferred embodiment, the acceleration fine adjustment characteristic information U includes a plurality (for example, four in the present preferred embodiment) of acceleration characteristic information U1, U2, U3, and U4. The deceleration fine adjustment characteristic information D associates the operation amount of the operation lever 5 with throttle opening degree setting values that are lower than the reference setting value. In the present preferred embodiment, the deceleration fine adjustment characteristic information D includes a plurality (for example, four in the present preferred embodiment) of deceleration characteristic information D1, D2, D3, and D4.

The four acceleration characteristic information U1, U2, U3, and U4 are set such that a degree of increase of the throttle opening degree setting value with respect to the reference setting value (reference characteristic information S) increases in a stepwise manner in the order from the acceleration characteristic information U1 to U4. The four deceleration characteristic information D1, D2, D3, and D4 are set such that a degree of decrease of the throttle opening degree setting value with respect to the reference setting value (reference characteristic information S) increases in stepwise manner in the order from the deceleration characteristic information D1 to D4. In other words, the nine characteristic information, made up of the reference characteristic information S, the four acceleration characteristic information U1 to U4, and the four deceleration characteristic information D1 to D4, form a characteristic information set with which the throttle opening degree setting values corresponding to the same operation amount of the operation lever 5 differ in a stepwise manner.

In addition, the acceleration fine adjustment characteristic information U is an example of "first fine adjustment characteristic information" according to a preferred embodiment of the present invention, and the acceleration characteristic information U1, U2, U3, and U4 are an example of "first sub characteristic information" according to a preferred embodiment of the present invention. Also, the deceleration fine adjustment characteristic information D is an example of "second fine adjustment characteristic information" according to a preferred embodiment of the present invention, and the deceleration characteristic information D1, D2, D3, and D4 are an example of "second sub characteristic information" according to a preferred embodiment of the present invention.

In the four acceleration characteristic information U1, U2, U3, and U4, the throttle opening degree setting values corresponding to the same operation amount (for example, T1 in FIG. 3) of the operation lever 5 increase stepwise at a substantially constant increment (for example, A1 in FIG. 3). Likewise, the four deceleration characteristic information D1, D2, D3, and D4, the throttle opening degree setting values corresponding to the same operation amount (for example, T1 in FIG. 3) of the operation lever 5 decrease stepwise at a substantially constant decrement (for example, B1 in FIG. 3). Also, for the same operation amount (for example, T1 in FIG. 3) of the operation lever 5, the increment (for example, A1 in FIG. 3) is set to be greater than the decrement (for example, B1 in FIG. 3). For the same operation amount of the operation lever 5, the increment A (A1, A2)

of the acceleration characteristic information U1, U2, U3, and U4 is greater than the decrement B (B1, B2) of the deceleration characteristic information D1, D2, D3, and D4. This relationship holds regardless of the operation amount of the operation lever 5.

Further, the increment A of the throttle opening degree setting value in the acceleration characteristic information U1, U2, U3, and U4 is set to increase in accordance with an increase of the operation amount of the operation lever 5. Likewise, the decrement B of the throttle opening degree setting value in the deceleration characteristic information D1, D2, D3, and D4 is set to increase in accordance with an increase of the operation amount of the operation lever 5. For example, the increment A2 for a case where the operation amount of the operation lever 5 is large (for example, T2 in FIG. 3) is greater than the increment A1 for a case where the operation amount of the operation lever 5 is small (for example, T1 in FIG. 3). Likewise, the decrement B2 for a case where the operation amount of the operation lever 5 is large (for example, T2 in FIG. 3) is greater than the decrement B1 for a case where the operation amount of the operation lever 5 is small (for example, T1 in FIG. 3).

In the present preferred embodiment, the engine ECU 36 is programmed to automatically switch between an ordinary control mode and an assisted control mode. The ordinary control mode is a control mode in which the engine ECU 36 uses just the reference characteristic information S to adjust the throttle opening degree. The assisted control mode is a control mode in which the engine ECU 36 uses the reference characteristic information S, the acceleration characteristic information U1 to U4, and the deceleration characteristic information D1 to D4 to adjust the throttle opening degree.

Specifically, when the engine 3 is started (when the engine ECU 36 is started), the engine ECU 36 sets the control mode to the ordinary control mode. The engine ECU 36 is arranged to switch the control mode to the assisted control mode when the operation amount of the operation lever 5 becomes not less than a first threshold T3 during control in the ordinary control mode. Also, the engine ECU 36 is arranged to switch the control mode to the ordinary control mode when the operation amount of the operation lever 5 falls below a second threshold T4 that is less than the first threshold T3 during control in the assisted control mode. The first threshold T3 is set such that the corresponding throttle opening degree setting value (reference setting value) in the reference characteristic information S is a throttle opening degree at which a traveling state transitions from a displacement state to a planing state. The displacement state refers to a state where the hull 2 travels so as to plow through water. The planing state refers to a state where the hull 2 rides above the water surface. More specifically, in the planing state, a stem side hull bottom is above the water surface and is generally separated from the water surface, the hull bottom is put in a state of contacting the water surface only near a stern, and the hull 2 planes along the water surface.

The first threshold T3 and the second threshold T4 are examples of a "first threshold" and a "second threshold" according to a preferred embodiment of the present invention, respectively. Also, the assisted control mode is an example of "control by the fine adjustment switch" according to a preferred embodiment according to a preferred embodiment of the present invention.

Also, the stepwise increment of the acceleration characteristic information U1 to U4 and the decrement of the deceleration characteristic information D1 to D4 decrease as the operation amount of the operation lever 5 approaches the second threshold T4 from the first threshold T3. The increment of the acceleration characteristic information U1 to U4 and the decrement of the deceleration characteristic information D1 to D4 become zero at the second threshold T4 at which the assisted control mode switches to the ordinary control mode. That is, respective throttle opening degree setting values of the acceleration characteristic information U1 to U4 and the deceleration characteristic information D1 to D4 are set to converge to the throttle opening degree setting value (reference setting value) of the reference characteristic information S in a vicinity of the second threshold T4.

In the present preferred embodiment, the marine vessel operator can manually switch among the plurality of characteristic information (reference characteristic information S, acceleration characteristic information U1 to U4, and deceleration characteristic information D1 to D4) in the assisted control mode. Specifically, when the marine vessel operator presses the up switch portion 8*a* of the fine adjustment switch 8, the characteristic information changes by one step in a manner such that the throttle opening degree setting value corresponding to the operation amount of the operation lever 5 increases. For example, when the up switch portion 8*a* is pressed with the reference characteristic information S being selected, the characteristic information is switched to the acceleration characteristic information U1. Also, when the up switch portion 8*a* is pressed with the deceleration characteristic information D1 being selected, the characteristic information is switched to the reference characteristic information S. Likewise, when the down switch portion 8*b* is pressed, the characteristic information changes by one step in a manner such that the throttle opening degree setting value corresponding to the operation amount of the operation lever 5 decreases. That is, for example, when the down switch portion 8*b* is pressed with the reference characteristic information S being selected, the characteristic information is switched to the deceleration characteristic information D1. Also, when the down switch portion 8*b* is pressed with the acceleration characteristic information U1 being selected, the characteristic information being switched to the reference characteristic information S.

Characteristic information switching control shall now be described in detail. When the up switch portion 8*a* or the down switch portion 8*b* is pressed, the operation is detected by the engine ECU 36. The engine ECU 36 judges that pressing has been performed just once even when the pressed state of the up switch portion 8*a* or the down switch portion 8*b* is maintained for not less than a predetermined time. The engine ECU 36 has a counter function (not shown), and a counter value is changed (incremented) by +1 when the up switch portion 8*a* is pressed, and the counter value is changed (decremented) by −1 when the down switch portion 8*b* is pressed. The counter value can take on the values of −4, −3, −2, −1, 0, +1, +2, +3, and +4. These counter values respectively correspond to the deceleration characteristic information D4, D3, D2, and D1, the reference characteristic information S, and the acceleration characteristic information U1, U2, U3, and U4. The engine ECU 36 increments or decrements the counter value according to the operation of the up switch portion 8*a* or the down switch portion 8*b*, and uses the characteristic information corresponding to the counter value to adjust the throttle opening degree.

In the present preferred embodiment, when the up switch portion 8*a* is pressed, the characteristic information is switched by one step such that the throttle opening degree setting value corresponding to the operation amount of the operation lever 5 increases. Moreover, the operation lever 5 is arranged such that its operation position is held. Thus, by operation of the up switch portion 8*a*, the throttle opening degree can be increased minutely without having to operate the operation lever 5. If the acceleration is insufficient, the up switch portion 8*a* can be pressed repeatedly to switch the characteristic information further by the number corresponding to the number of times of pressing. When deceleration is desired, the marine vessel operator presses the down switch portion 8*b* to switch the characteristic information by one step so that the throttle opening degree setting value corresponding to the operation amount of the operation lever 5 decreases. Thus, by operation of the down switch portion 8*b*, the throttle opening degree can be decreased minutely without having to operate the operation lever 5. If the deceleration is insufficient, the down switch portion 8*b* can be pressed repeatedly to switch the characteristic information further by the number corresponding to the number of times of pressing.

When the operation lever 5 is rotatingly operated, the throttle opening degree setting value is increased or decreased according to the characteristic information being selected at that time. A correlation (linearity) between the operation lever 5 and the throttle opening degree is thereby maintained. The throttle opening degree can thus be adjusted by either the rotation operation of the operation lever 5 or the pressing operation of the fine adjustment switch 8, and a plurality of operation systems differing in operation mode can be provided. The marine vessel operator selects the operating system that is easy to use according to the traveling circumstances. Further, whereas the change of the throttle opening degree setting value by the operation lever 5 is continuous, the throttle opening degree setting value by the fine adjustment switch 8 changes in a step-like manner. The throttle opening degree setting value can thus be changed in a continuous manner or in a stepwise manner according to the traveling circumstances. The plurality of operation systems that differ in the mode of change of the throttle opening degree setting value can thus be provided.

In addition, when the up switch portion 8*a* is pressed during control according to the acceleration characteristic information U4, the engine ECU 36 continues control according to the acceleration characteristic information U4. Likewise, when the down switch portion 8*b* is pressed during control according to the deceleration characteristic information D4, the engine ECU 36 continues control according to the deceleration characteristic information D4. That is, in the width of adjustment by the fine adjustment switch 8, the acceleration characteristic information U4 and the deceleration characteristic information D4 define the limiting values. The throttle opening degree is thus adjusted within a range defined by the acceleration characteristic information U4 and the deceleration characteristic information D4.

The buzzer unit 9 disposed on the dashboard 2*c* (see FIG. 1 and FIG. 2) has a function of generating a buzzer sound when the fine adjustment switch 8 is operated. The operation of the fine adjustment switch 8 is thereby be notified to the marine vessel operator. The buzzer unit 9 may be controlled by the engine ECU 36 so as to be driven in response to the operation of the fine adjustment switch 8. For example, when the engine ECU 36 detects the operation of the fine adjustment switch 8, a buzzer drive command may be provided from the engine ECU 36 to the hull ECU 7 and, in response, the buzzer unit 9 may be driven by the hull ECU 7.

Figure 4:
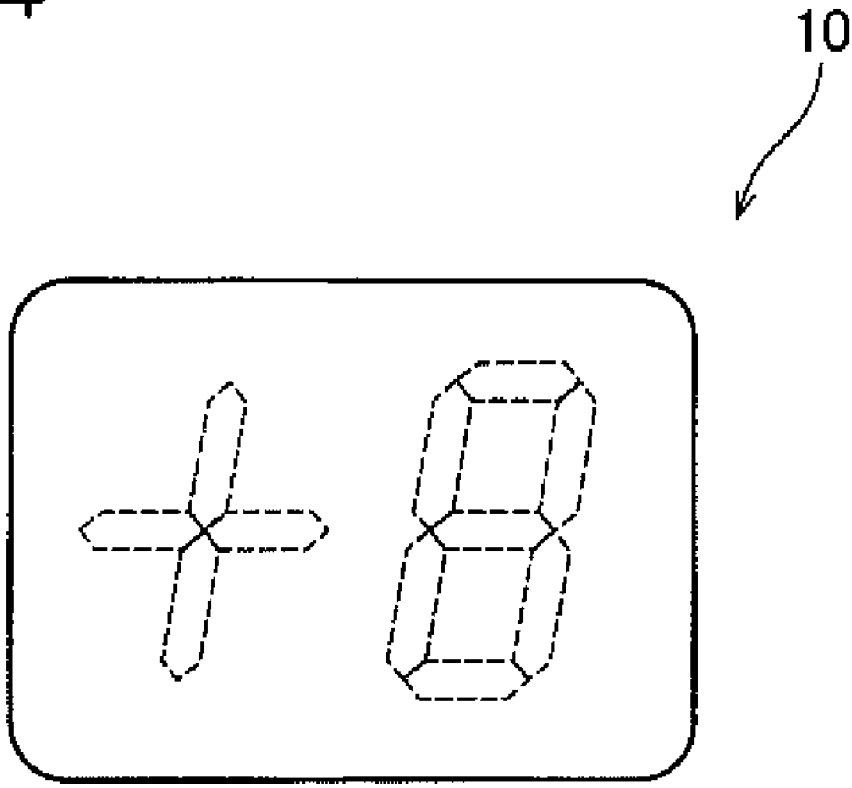
FIG. 4 is a diagram of a display unit of the boat.

FIG. 4 shows a specific arrangement example of the display unit 10 disposed on the dashboard 2*c* (see FIG. 1 and FIG. 2). The display unit 10 has a function of displaying the counter value (integer value within a range of −4 to +4) corresponding to the characteristic information. By the value displayed on the display unit 10, the marine vessel operator can confirm which characteristic information is the currently applied characteristic information. The display unit 10 may be arranged to perform a display operation in accordance with the counter value provided from the engine ECU 36. For example, the counter value may be provided from the engine ECU 36 to the hull ECU 7, and the counter value may in turn be provided from the hull ECU 7 to the display unit 10.

Figure 5:
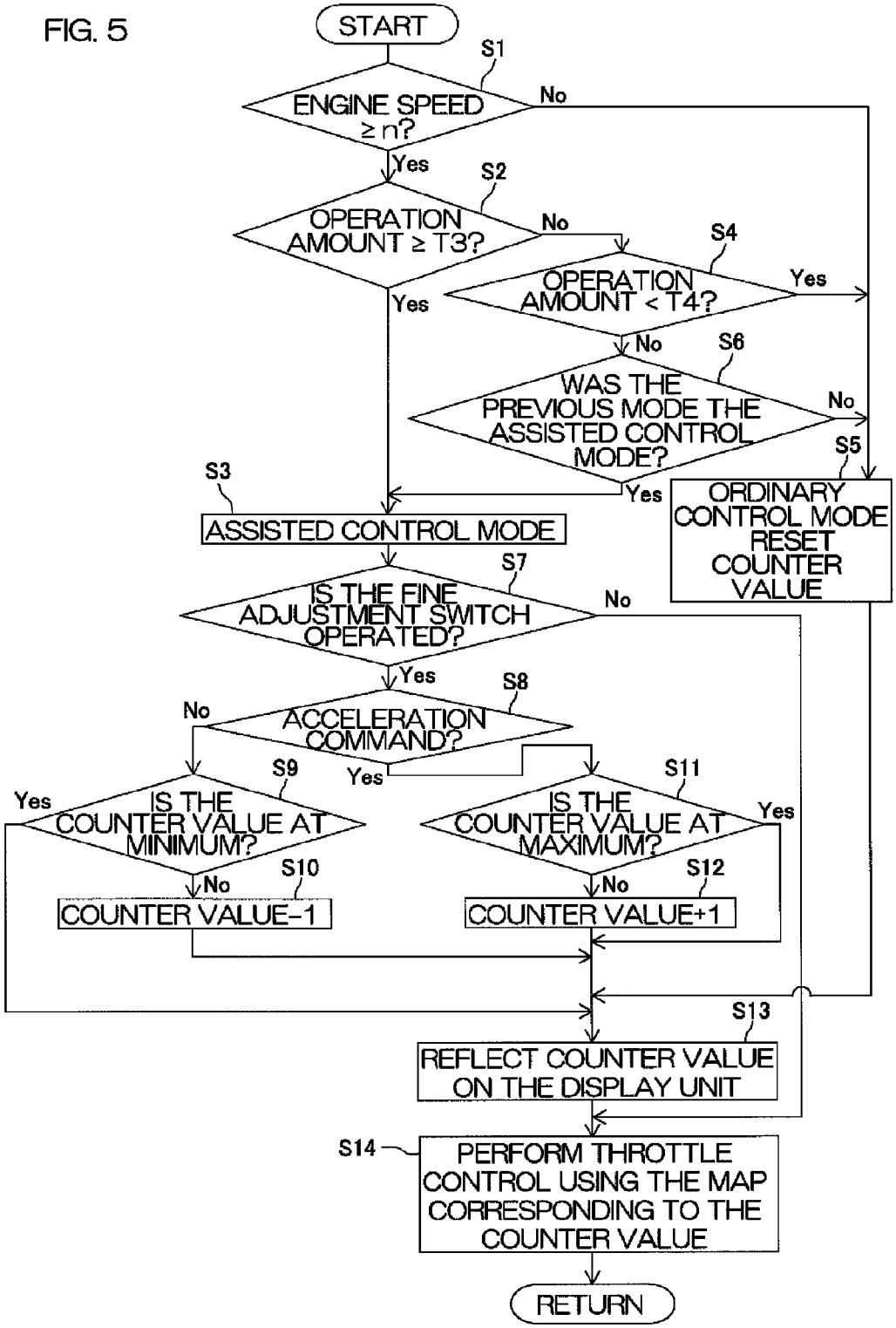
FIG. 5 is a flowchart for describing throttle control of the boat.

FIG. 5 is a flowchart for describing the throttle opening degree control in the pleasure boat 1. The flowchart illustrates an example of a process that is repeated at each predetermined control cycle by the engine ECU 36.

First, in step S1 in FIG. 5, the engine ECU 36 determines whether or not the engine speed is not less than a predetermined rotational speed n. The engine speed n is an engine speed corresponding to the speed at which the displacement state, in which the hull 2 travels so as to plow through water, transitions to the planing state, in which the hull 2 travels so as to ride on the water surface. If the engine speed is less than the predetermined rotational speed n, the engine ECU 36 selects the ordinary control mode as the control mode and resets the counter value to "0" in step S5. That is, when the engine speed is less than the predetermined rotational speed n, operation of the fine adjustment switch 8 is ineffective and the engine ECU 36 adjusts the throttle opening degree exclusively based on the operation amount of the operation lever 5.

If the engine speed is not less than the predetermined rotational speed n, the engine ECU 36 determines whether or not the operation amount of the operation lever 5 is not less than the first threshold T3 in step S2. If the operation amount of the operation lever 5 is less than the first threshold 13, the engine ECU 36 determines whether or not the operation amount of the operation lever 5 is less than the second threshold T4 in step S4. If the operation amount of the operation lever 5 is less than the second threshold T4, the engine ECU 36 selects the ordinary control mode in step S5. Also, if in step S2, the operation amount of the operation lever is not less than the first threshold T3, the engine ECU 36 selects the assisted control mode as the control mode in step S3. That is, the engine ECU 36 adjusts the throttle opening degree not only in accordance with the operation amount of the operation lever 5 but also in accordance with the operation of the fine adjustment switch 8. As a result, the throttle opening degree adjustment by the operation of the fine adjustment switch 8 is highly effective.

If the operation amount of the operation lever 5 is not less than the second threshold T4 in step S4, the engine ECU 36 determines in step S6 whether or not the control mode in the previous control cycle was the assisted control mode. If the previous control mode was the assisted control mode, step S3 is entered and the engine ECU 36 selects the assisted control mode. If the previous control mode was the ordinary control mode, step S5 is entered and the engine ECU 36 selects the ordinary control mode. In this case, the counter value is held at "0."

In the case where the ordinary control mode is selected and the counter value is set to "0" in step S5, the display on the display unit 10 is set to "0" (step S13). Further, the engine ECU 36 drives the actuator 32 so as to adjust the throttle opening degree based on the operation amount of the operation lever 5 and the reference characteristic information S (step S14). The reference characteristic information S is a map corresponding to the counter value of "0."

Also, in the case where the assisted control mode is selected in step S3, the engine ECU 36 drives the actuator 32 so as to adjust the throttle opening degree based on the characteristic information selected by the operation of the fine adjustment switch 8 and the operation amount of the operation lever 5 (step S14). In this case, the throttle opening degree setting value is to follow any of the acceleration characteristic information U1 to U4, the reference characteristic information S, and the deceleration characteristic information D1 to D4.

Specifically, in step S7, the engine ECU 36 determines whether or not the fine adjustment switch 8 is operated. If the fine adjustment switch 8 is not operated, step S14 is entered and the engine ECU 36 controls the throttle opening degree using the characteristic information corresponding to the current counter value. Immediately after transition into the assisted control mode, the counter value is "0" and the throttle opening degree is thus adjusted using the reference characteristic information S.

If the fine adjustment switch 8 is operated, the engine ECU 36 determines in step S8 whether or not the operation is an acceleration command. That is, the engine ECU 36 determines whether the up switch portion 8*a* is pressed or the down switch portion 8*b* is pressed. If the up switch portion 8*a* is pressed, the engine ECU 36 determines that the acceleration command is issued and determines in step S11 whether or not the counter value is maximum (+4 in the present preferred embodiment). If the counter value is maximum, the process of the engine ECU 36 enters step S13 without changing the counter value. If the counter value is not maximum, the engine ECU 36 changes (increments) the counter value by +1 in step S12 and then enters step S13.

Also, if the down switch portion 8*b* is pressed, the engine ECU 36 determines that the deceleration command is issued and determines in step S9 whether or not the counter value is minimum (−4 in the present preferred embodiment). If the counter value is minimum, the process of the engine ECU 36 enters step S13 without changing the counter value. If the counter value is not minimum, the engine ECU 36 changes (decrements) the counter value by −1 in step S10 and then enters step S13.

Then, in step S13, the engine ECU 36 displays a numeral corresponding to the counter value on the display unit 10. Also, in step S14, the engine ECU 36 selects the characteristic information (any of acceleration characteristic information U1 to U4, the reference characteristic information S, and the deceleration characteristic information D1 to D4) corresponding to the counter value. The engine ECU 36 drives the actuator 32 to adjust the throttle opening degree based on the selected characteristic information and the operation amount of the operation lever 5.

In the case where the ordinary control mode is selected (step S5), the counter value is reset to "0," and "0" is thus displayed on the display unit 10 accordingly (step S13). The engine ECU 36 then applies the operation amount of the operation lever 5 to the reference characteristic information S to determine the throttle opening degree setting value and adjusts the throttle opening degree based on this throttle opening degree setting value.

Figure 6:
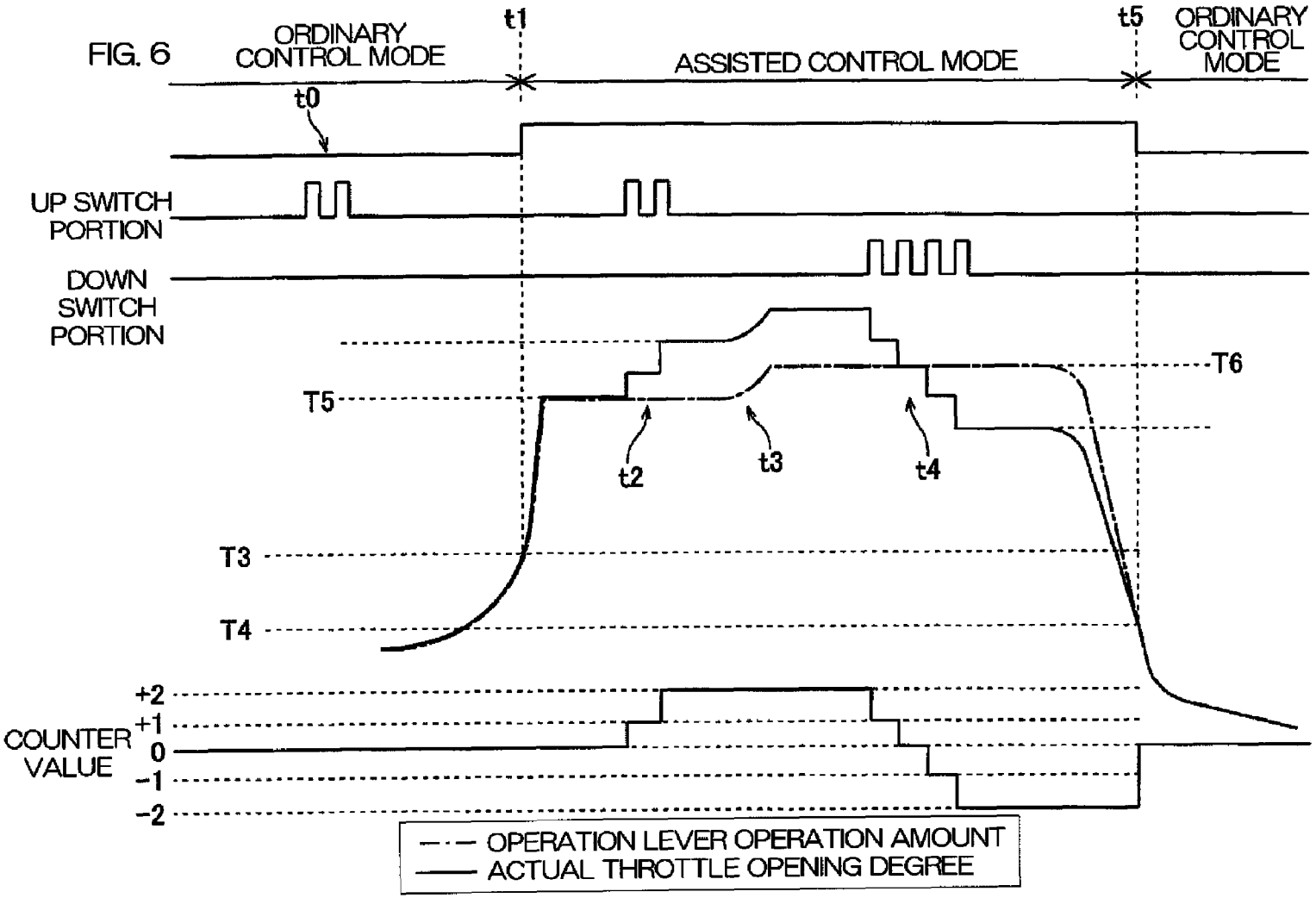
FIG. 6 is a timing chart for describing the throttle control of the boat.

FIG. 6 is a timing chart for describing a specific example of the throttle control of the pleasure boat 1.

In the case where the operation amount of the operation lever 5 is 0, the ordinary control mode is selected. As the marine vessel operator increases the operation amount (indicated by a chain line in FIG. 6) of the operation lever 5 from this state, the throttle opening degree (indicated by a solid line in FIG. 6) increases with the increase of the operation amount of the operation lever 5, and the engine speed rises accordingly. In the ordinary control mode, even when the fine adjustment switch 8 is operated, the counter value is held at "0" and the throttle opening degree does not change. In the example of FIG. 6, at a timing t0, the throttle opening degree does not change even though the up switch portion 8*a* is operated twice.

When the operation amount of the operation lever 5 exceeds the first threshold T3 (timing t1), the ordinary control mode transitions to the assisted control mode. After the transition to the assisted control mode, fine adjustment of the throttle opening degree is enabled by pressing of the up switch portion 8*a* and the down switch portion 8*b* even if the operation lever 5 is not operated. In the example of FIG. 6, in a state where the operation amount of the operation lever 5 is held at T5, the up switch portion 8*a* is pressed twice at the timing t2. The counter value thus becomes +2, and accordingly, the characteristic information changes from the reference characteristic information S to the acceleration characteristic information U2 via the acceleration characteristic information U1. With the acceleration characteristic information U2, the throttle opening degree setting value corresponding to the operation amount of the operation lever 5 is higher than the reference characteristic information S. Thus, even if the operation lever 5 is not operated, the throttle opening degree increases. The operation amount (operation position) of the operation lever 5 is held even if the marine vessel operator does not operate to hold the operation lever 5. By the up switch portion 8*a* being operated twice in this state, the throttle opening degree setting value corresponding to the held operation amount increases by two steps and changes from a value in accordance with the reference characteristic information S to a value in accordance with the acceleration characteristic information U2.

At a timing t3, the operation lever 5 is operated (operated from T5 to T6). At this time, the engine ECU 36 applies the operation amount of the operation lever 5 to the acceleration characteristic information U2 to determine the throttle opening degree setting value. The throttle opening degree thus changes in accordance with the operation of the operation lever 5. That is, there is linearity (a linear correlation) in the relationship of the operation amount of the operation lever 5 and the throttle opening degree.

Thereafter, at a timing t4, the down switch portion 8*b* is pressed four times. The counter value thereby changes from +2 to −2, and accordingly, the characteristic information is changed from the acceleration characteristic information U2 to the deceleration characteristic information D2 via the acceleration characteristic information U1, the reference characteristic information S, and the deceleration characteristic information D1. In accordance with this, the throttle opening degree decreases in four steps. The operation amount (operation position) of the operation lever 5 is held even if the marine vessel operator does not operate to hold the operation lever 5. By the down switch portion 8*b* being operated four times in this state, the throttle opening degree setting value corresponding to the held operation amount decreases by four steps and changes from a value in accordance with the acceleration characteristic information U2 to a value in accordance with the deceleration characteristic information D2.

When the operation amount of the operation lever 5 is decreased thereafter, the throttle opening degree setting value changes in accordance with the deceleration characteristic information D2. In this process, there is linearity in the relationship of the operation amount of the operation lever 5 and the throttle opening degree.

At a timing t5, the operation amount of the operation lever 5 falls below the second threshold T4. The control mode of the engine ECU 36 thereby transitions from the assisted control mode to the ordinary control mode. In transitioning to the ordinary control mode, the counter value is reset to "0."

In the present preferred embodiment, the throttle opening degree can be finely adjusted readily by operation of the fine adjustment switch 8 even without operating the operation lever 5 as described above. Marine vessel maneuvering is thereby made easy, for example, when traveling with the speed of the pleasure boat 1 being kept constant is desired. That is, in a case where the speed of the pleasure boat 1 changes frequently due to waves, wind, etc., the speed can be increased or decreased by the fine adjustment switch 8 while keeping constant the operation amount of the operation lever 5 (that is, without operating the operation lever 5). Under such circumstances, it is easier to adjust the throttle opening degree by the fine adjustment switch 8 than to adjust the throttle opening degree by frequent operation of the operation lever 5. Thus, in the case of performing traveling at a constant speed, the operating load of the marine vessel operator can be minimized and the tiring of the marine vessel operator can thus be prevented.

Also, in the present preferred embodiment, the throttle opening degree is adjusted based on the operation amount of the operation lever 5, the reference characteristic information S, acceleration characteristic information U1 to U4, and deceleration characteristic information D1 to D4 stored in the memory 37 of the engine ECU 36, and the operation state of the fine adjustment switch 8. Thus, unlike in a case of performing cruise control, the throttle opening degree can be finely adjusted by the fine adjustment switch 8 while constantly maintaining the correlation between the operation amount of the operation lever 5 and the throttle opening degree. Thus, even after the characteristic information is switched by the operation of the fine adjustment switch 8, when the operation lever 5 is operated, the throttle opening degree changes according to its operation amount. Also, when the fine adjustment switch 8 is operated after the operation amount of the operation lever 5 is changed, the throttle opening degree setting value changes minutely in a stepwise manner in accordance with the changed lever operation amount. When the marine vessel operator operates the operation lever 5 in order to accelerate or decelerate and also performs fine adjustment by the fine adjustment switch 8, the pleasure boat 1 can be accelerated or decelerated in accordance with both the operations of the operation lever 5 and the fine adjustment switch 8. Thus, in the assisted control mode, the throttle opening degree responds to operations of both the operation lever 5 and the fine adjustment switch 8, and generation of an uncomfortable feeling in the marine vessel operator can thus be prevented. That is, occurrence of a circumstance where the throttle opening degree is not changed even though an operation of changing the throttle opening degree is performed can be prevented.

Also, in the present preferred embodiment, the throttle opening degree is increased in accordance with the operation amount of the up switch portion 8*a* and the throttle opening degree is decreased in accordance with the operation amount of the down switch portion 8*b* as described above. By this arrangement, the marine vessel operator can readily perform fine adjustment by increasing and decreasing the throttle opening degree by operating the up switch portion 8*a* and the down switch portion 8*b*.

Also, in the present preferred embodiment, when the up switch portion 8*a* is operated or pressed, the characteristic information is selected such that the throttle opening degree setting value corresponding to the operation amount of the operation lever 5 increases as described above. Also, when the down switch portion 8*b* is operated or pressed, the characteristic information is selected such that the throttle opening degree setting value corresponding to the operation amount of the operation lever 5 decreases. The throttle opening degree is thereby adjusted based on the operation amount of the operation lever 5 and the selected characteristic information. Selection among characteristic information, which differ in the throttle opening degree setting value corresponding to the operation amount of the operation lever 5, is thereby made according to the operation of the fine adjustment switch 8. Consequently, the throttle opening degree can be finely adjusted without having to operate the operation lever 5. Also, because the throttle opening degree being adjusted based on the operation amount of the operation lever 5 and the selected characteristic information, fine adjustment of the throttle opening degree can be performed while maintaining the correlation between the operation amount of the operation lever 5 and the throttle opening degree. An uncomfortable feeling of the marine vessel operator can thus be prevented.

Also, in the present preferred embodiment, the reference characteristic information S, the acceleration characteristic information U1 to U4, and the deceleration characteristic information D1 to D4 are preferably used. With the acceleration characteristic information U1 to U4, the throttle opening degree setting values corresponding to the operation amount of the operation lever 5 are higher than those with the reference characteristic information S. With deceleration characteristic information D1 to D4, the throttle opening degree setting values corresponding to the operation amount of the operation lever 5 are lower than those with the reference characteristic information S. In a case where traveling at a constant speed is performed using the reference characteristic information S, when the speed decreases due to the influence of waves, etc., the marine vessel operator can change to the acceleration characteristic information U1 to U4 by pressing the up switch portion 8*a*. The throttle opening degree can thereby be increased. That is, the marine vessel operator can readily return the decreased speed to the original speed without having to operate the operation lever 5. Likewise, in a case where traveling at a constant speed is performed using the reference characteristic information S, when the speed increases, the marine vessel operator can change to the deceleration characteristic information D1 to D4 by pressing the down switch portion 8*b*. The throttle opening degree can thereby be decreased. That is, the marine vessel operator can readily return the increased speed to the original speed without having to operate the operation lever 5.

Also, in the present preferred embodiment, the plurality of acceleration characteristic information U1 to U4 are determined such that the degree of increase of the throttle opening degree setting value with respect to the reference setting value that follows the reference characteristic information S increases in a stepwise manner as described above. Also, the plurality of deceleration characteristic information D1 to D4 are determined such that the degree of decrease of the throttle opening degree setting value with respect to the reference setting value that follows the reference characteristic information S increases in a stepwise manner. By this arrangement, the marine vessel operator can use the fine adjustment switch 8 to select any of the stepwise-set acceleration characteristic information U1 to U4, the reference characteristic information S, and the stepwise-set deceleration characteristic information D1 to D4. Adjustment of the speed (adjustment of the throttle opening degree) can thereby be performed more finely.

Also, in the present preferred embodiment, the plurality of acceleration characteristic information U1 to U4 are determined such that the throttle opening degree setting values corresponding to the same operation amount of the operation lever 5 increase in a stepwise manner by the substantially fixed increment A as described above. Also, the plurality of deceleration characteristic information D1 to D4 are determined such that the throttle opening degree setting values corresponding to the same operation amount of the operation lever 5 decreases in a stepwise manner by the substantially fixed decrement B. Further, the increment A of the acceleration characteristic information U1 to U4 is set to be greater than the decrement B of the deceleration characteristic information D1 to D4. By this arrangement, an uncomfortable feeling of the marine vessel operator due to the change amount of the speed of the hull 2 differing between the case where the up switch portion 8*a* is pressed and the case where the down switch portion 8*b* is pressed (due to the degree of increase and the degree of decrease in the speed differing) is minimized and prevented. That is, resistance due to water is always applied to the hull 2. The amount of change of speed of the hull 2 thus differs between the case where the throttle opening degree is increased by a certain amount and the case where the throttle opening degree is decreased by the same amount. That is, the decrement of the speed of the hull 2 when the throttle opening degree is decreased is greater than the increment of the speed of the hull 2 when the throttle opening degree is increased. Thus, in the present preferred embodiment, the increment of the throttle opening degree (the increment A of the acceleration characteristic information U1 to U4) is made greater than the decrement (the decrement B of the deceleration characteristic information D1 to D4). The difference between the increment and the decrement of the speed can thereby be made small when the characteristic information is switched by the operation of the fine adjustment switch 8. Consequently, the marine vessel operator can perform speed adjustment by the fine adjustment switch 8 (fine adjustment of the throttle opening degree) readily.

Also, the present preferred embodiment is arranged such that when the fine adjustment switch 8 is operated once, the characteristic information is changed by just one step even if the pressing state of the fine adjustment switch 8 is maintained for not less than the predetermined time as described above. The speed of the hull 2 can thereby be prevented from increasing or decreasing excessively against the intention of the marine vessel operator even when the fine adjustment switch 8 is pressed continuously for not less than the predetermined time.

Also, in the present preferred embodiment, the control mode transitions to the assisted control mode when the operation amount of the operation lever 5 becomes not less than the first threshold T3 as described above. For example, the first threshold T3 may be set in accordance with a speed range in which traveling at a constant speed is desired. Traveling at the constant speed can thereby be performed easily by performing fine adjustment of the throttle opening degree by the fine adjustment switch 8 in the speed range corresponding to an operation amount not less than the first threshold T3. On the other hand, in the case where the operation amount is less than the first threshold T3, the adjustment of the throttle opening degree can exclusively be performed by operation of the operation lever 5. Changing of the throttle opening degree setting value in a step-like manner by the operation of the fine adjustment switch 8 can thereby be suppressed in the low speed range. Changing of the hull behavior in the low speed range can thereby be suppressed and an uncomfortable feeling for the crew member can thus be minimized and prevented.

Also, in the present preferred embodiment, the first threshold T3 corresponds to the throttle opening degree at which the transition from the displacement state, where the hull 2 travels so as to plow through water, to the planing state, where the hull 2 rides above the water surface, occurs as described above. The pleasure boat 1 is in the planing state, for example, in a case where a wakeboard is pulled at a constant speed by the pleasure boat 1. Thus, by setting the first threshold T3 as described above, the pleasure boat 1 can be made to plane along the water surface at the constant speed in the state where control in accordance with the assisted control mode is performed. The throttle opening degree adjustment by the operation of the fine adjustment switch 8 is thereby enabled and the tiring of the marine vessel operator can thus be prevented.

Also, in the present preferred embodiment, the assisted control mode is started when the engine speed become not less than the rotation speed n at which the transition from the displacement state, where the hull 2 travels so as to plow through water, to the planing state, where the hull 2 rides above the water surface, occurs as described above. The assisted control mode can thereby be started upon confirmation of the transition of the hull 2 into the planing mode by the engine speed in addition to the operation amount of the operation lever 5. The assisted control mode can thereby be started reliably after the hull 2 has transitioned into the planing mode.

Also, in the present preferred embodiment, transition from the assisted control mode to the ordinary control mode is performed when, in the state of the assisted control mode, the operation amount of the operation lever 5 falls below the second threshold T4, which is lower than the first threshold T3, as described above. Thus, after transition into the assisted control mode by the operation amount of the operation lever 5 exceeding the first threshold T3, the assisted control mode is not stopped unless the operation amount of the operation lever 5 is decreased to the second threshold T4. The assisted control mode can thus be prevented from stopping immediately after it is started.

Also, in the present preferred embodiment, the width of throttle opening degree adjustment by the operation of the fine adjustment switch 8 decreases gradually as the operation amount of the operation lever 5 approaches the second threshold T4 from the first threshold T3 and becomes substantially zero at the second threshold T4 as described above. The width of adjustment by the fine adjustment switch 8 thereby becomes substantially zero at the timing at which the assisted control mode is stopped (the operation amount of the operation lever 5 becomes T4). The throttle opening degree can thus be prevented from varying suddenly when the assisted control mode is stopped.

Also, in the present preferred embodiment, the larger the width of throttle opening degree adjustment by the operation of the fine adjustment switch 8 is set, the larger the operation amount of the operation lever 5 becomes as described above. Fine adjustment by a large amount can thereby be performed by the fine adjustment switch 8 when the operation amount of the operation lever 5 is large, and fine adjustment by a small amount can be performed by the fine adjustment switch 8 when the operation amount of the operation lever 5 is small. Therefore, by the fine adjustment switch 8, the throttle opening degree can be adjusted finely by a magnitude in accordance with the operation amount of the operation lever 5. In the low throttle opening degree range, the change of engine output with respect to the change of throttle opening degree is comparatively large. Thus, by suppressing the change of throttle opening degree by the operation of the fine adjustment switch 8 in the low throttle opening degree range, the behavior of the pleasure boat 1 can be stabilized. Thus, crew members and operators are prevented from experiencing any uncomfortable feelings caused by the change of throttle opening degree. On the other hand, in a high throttle opening degree range, the change of engine output with respect to the change of throttle opening degree is comparatively small. Thus, by making the width of change of throttle opening degree by the operation of the fine adjustment switch 8 large in the high throttle opening degree range, the required propulsive force change can be obtained.

Also, in the present preferred embodiment, the fine adjustment switch 8 is provided near the operation lever 5 such that the fine adjustment switch 8 and the operation lever 5 are disposed at positions close to each other as described above. The marine vessel operator can thereby operate the fine adjustment switch 8 without having to move from a position of operating the operation lever 5.

Also, in the present preferred embodiment, the display unit 10, which notifies the operation state of the fine adjustment switch 8 to the marine vessel operator, is provided as described above. The marine vessel operator can thereby readily recognize the operation state of the fine adjustment switch 8 by the display on the display unit 10.

Also, in the present preferred embodiment, the buzzer unit 9, which notifies the marine vessel operator of what the fine adjustment switch 8 is operated, is preferably provided as described above. Thus, when the marine vessel operator operates the fine adjustment switch 8, the operator can confirm by the buzzer unit 9 that the operation of the fine adjustment switch 8 has been accepted.

In addition, it is to be understood that the present preferred embodiment disclosed herein is by all means illustrative and not restrictive. The scope of the present invention is defined by the claims and not by the preceding description of the preferred embodiments, and all changes that fall within the metes and bounds of the claims or equivalence of such metes and bounds are therefore intended to be embraced by the claims.

Figure 7:
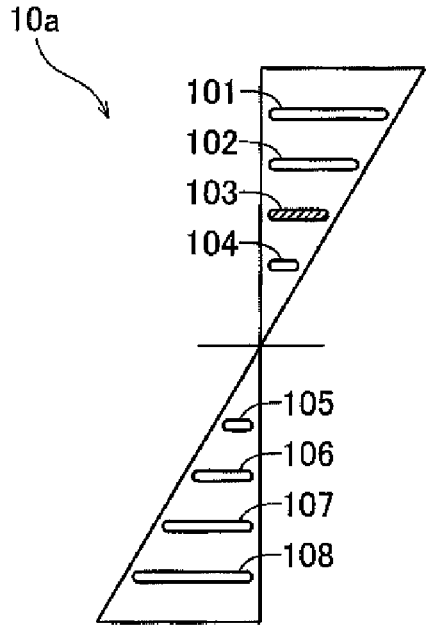
FIG. 7 is a diagram of a display unit according to a first modification example.
Figure 8:
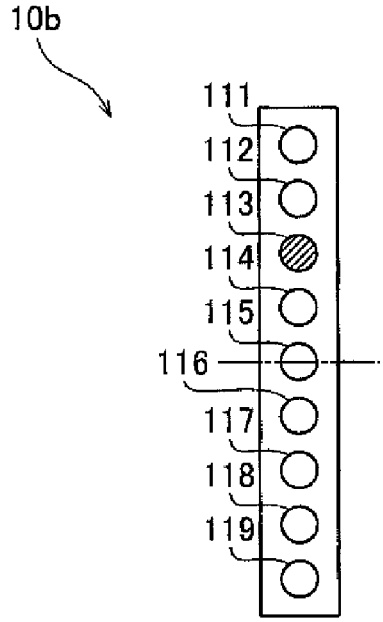
FIG. 8 is a diagram of a display unit according to a second modification example.

Although with the preferred embodiments, an example has been described where the operation state of the fine adjustment switch 8 is notified to the marine vessel operator preferably by display of the counter value on the display unit 10, the present invention is not restricted thereto. For example, the operation state of the fine adjustment switch 8 may be notified by an indicator 10*a* as in a first modification example shown in FIG. 7. In the first modification example, lighting units 101 to 104 correspond respectively to acceleration characteristic information U4 to U1, and lighting units 105 to 108 correspond respectively to deceleration characteristic information D1 to D4. The marine vessel operator can recognize the characteristic information being used by lighting of any of the lighting units 101 to 108. Also, the operation state of the fine adjustment switch 8 may be notified by an indicator 10*b* as in a second modification example shown in FIG. 8. In the second modification example, lighting units 111 to 114 correspond respectively to acceleration characteristic information U4 to U1, a lighting unit 115 corresponds to the reference characteristic information S, and lighting units 116 to 119 correspond respectively to deceleration characteristic information D1 to D4. In addition, each of the indicators 10*a* and 10*b* is an example of the "first notification unit" according to a preferred embodiment of the present invention.

Also, in the preferred embodiments, although four acceleration characteristic information U1 to U4 and four deceleration characteristic information D1 to D4 are preferably provided, the present invention is not restricted thereto. That is, just one each, or two or three each, or five or more each of the acceleration characteristic information and the deceleration characteristic information may be provided.

Also, the present preferred embodiment has an arrangement such that the throttle opening degree is increased or decreased by switching the map (see FIG. 3) expressing the characteristic information when the up switch portion 8*a* or the down switch portion 8*b* is pressed. However, the present invention is not restricted to this example. For example, each time the up switch portion 8*a* or the down switch portion 8*b* is pressed, an increment or decrement of the throttle opening degree may be calculated by computation and the throttle opening degree may be increased or decreased from the current value by an amount corresponding to the calculated value.

Also, in the present preferred embodiment, although the present invention has preferably been applied to the pleasure boat 1 with which the jet propulsion devices 4 are used to propel the hull 2, the present invention is not restricted thereto. That is, for example, the present invention may also be applied to a marine vessel that uses an outboard motor as an example of the propulsion device to propel a hull. Also, the present invention may be applied to an inboard motor boat or an inboard/outboard motor boat. Further, in the present preferred embodiment, although two propulsion devices (jet propulsion devices 4) are preferably provided, the number of propulsion devices may be one or three or more.

Also, in the preferred embodiments, although transition to the assisted control mode is performed when the operation amount of the operation lever 5 becomes not less than the first threshold T3, the present invention is not restricted thereto. For example, the control mode of the engine ECUs 36 may always be set the aforementioned assisted control mode. Also, in providing a threshold for transitioning from the ordinary control mode to the assisted control mode, the threshold may be set as suited according to the application of the marine vessel.

Also, in the preferred embodiments, although the fine adjustment switch 8 is provided on the operation lever 5, the present invention is not restricted thereto. The fine adjustment switch 8 may, for example, be disposed at another position near the operation lever 5. Specifically, the fine adjustment switch 8 may be provided on the handle 6 or the dashboard 2*c*, etc.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The present application corresponds to Japanese Patent Application No. 2009-052846 filed in the Japan Patent Office on Mar. 6, 2009, and the entire disclosure of the application is incorporated herein by reference.

What is claimed is:

1. A marine vessel comprising:

a hull;

a propulsion device arranged to propel the hull by a driving force of an engine having a throttle valve arranged to be electrically controlled so as to open and close;

an operation lever arranged to be operated by a marine vessel operator to adjust a throttle opening degree of the throttle valve, the operation lever arranged to hold an operation position;

a fine adjustment switch arranged to be operated by the marine vessel operator to increase or decrease the throttle opening degree, which has been adjusted by the operation of the operation lever, to further adjust the throttle opening degree that has been adjusted by the operation lever;

a control unit arranged to adjust the throttle opening degree based on an operation amount of the operation lever and an operation state of the fine adjustment switch; and a storage unit arranged to store reference information expressing a correspondence relationship between the operation amount of the operation lever and a reference setting value of the throttle opening degree, first fine adjustment information defining a throttle opening degree setting value higher than the reference setting value corresponding to the operation amount of the operation lever, and second fine adjustment information defining a throttle opening degree setting value lower than the reference setting value corresponding to the operation amount of the operation lever; wherein the fine adjustment switch includes an up switch portion arranged to be operated by the marine vessel operator to increase the throttle opening degree that has been adjusted by the operation of the operation lever, and a down switch portion arranged to be operated by the marine vessel operator to decrease the throttle opening degree that has been adjusted by the operation of the operation lever;

the control unit is arranged to increase the throttle opening degree according to the operation amount of the up switch portion when the up switch portion is operated, and to decrease the throttle opening degree according to the operation amount of the down switch portion when the down switch portion is operated; and the control unit is further arranged to select the reference information, the first fine adjustment information, or the second fine adjustment information according to the operation of the up switch portion or the down switch portion, and to set the throttle opening degree based on the operation amount of the operation lever and the selected information.

2. The marine vessel according to claim 1, wherein the control unit is arranged to select the first fine adjustment information when the up switch portion is operated with the reference information having been selected, and to select the second fine adjustment information when the down switch portion is operated with the reference information having been selected.

3. The marine vessel according to claim 1, wherein the first fine adjustment information includes a plurality of first sub information defined such that a degree of increase of the throttle opening degree setting value with respect to the reference setting value increases in a stepwise manner; and the second fine adjustment information includes a plurality of second sub information defined such that a degree of decrease of the throttle opening degree setting value with respect to the reference setting value increases in a stepwise manner.

4. The marine vessel according to claim 3, wherein the plurality of first sub information includes a plurality of information defined such that throttle opening degree setting values corresponding to a same operation amount of the operation lever increase in a stepwise manner at a substantially constant increment, and the plurality of second sub information includes a plurality of information defined such that throttle opening degree setting values corresponding to a same operation amount of the operation lever decrease in a stepwise manner at a substantially constant decrement that is smaller than the increment.

5. The marine vessel according to claim 3, wherein the reference information, the plurality of first sub information, and the plurality of second sub information define an information set with which the throttle opening degree setting values corresponding to a same operation amount of the operation lever differ in a stepwise manner, and the control unit is arranged to select information that differs from the currently selected information by one step when the fine adjustment switch is operated once.

6. The marine vessel according to claim 5, wherein the control unit is arranged to select information that differs from the currently selected information by one step even when the fine adjustment switch is operated once and the operation of the fine adjustment switch is maintained for not less than a predetermined time.

7. The marine vessel according to claim 1, wherein the control unit is arranged to perform control of adjusting the throttle opening degree based on the operation state of the fine adjustment switch in addition to the operation amount of the operation lever when the operation amount of the operation lever becomes not less than a predetermined first threshold.

8. The marine vessel according to claim 7, wherein the first threshold corresponds to a throttle opening degree of transition from a state in which the hull travels plowing through water to a planing state in which the hull travels riding on a water surface.

9. The marine vessel according to claim 8, wherein the control unit is arranged to perform control of adjusting the throttle opening degree based on the operation state of the fine adjustment switch in addition to the operation amount of the operation lever when the operation amount of the operation lever becomes not less than the first threshold and an engine speed becomes not less than a rotational speed at which the state in which the hull travels plowing through water transitions to the planing state in which the hull travels riding on the water surface.

10. The marine vessel according to claim 7, wherein the control unit is arranged to stop control by the fine adjustment switch when, in a state in which control by the fine adjustment switch is being performed, the operation amount of the operation lever falls below a second threshold less than the first threshold.

11. The marine vessel according to claim 10, wherein a width of throttle opening degree adjustment by the fine adjustment switch decreases as the operation amount of the operation lever approaches the second threshold from the first threshold, and at the second threshold, the width of throttle opening degree adjustment by the fine adjustment switch becomes substantially zero.

12. The marine vessel according to claim 1, wherein a maximum adjustment width of throttle opening degree by operation of the fine adjustment switch is set in advance, and the control unit is arranged to adjust the throttle opening degree within the maximum adjustment width when the fine adjustment switch is operated.

13. The marine vessel according to claim 1, wherein the larger the width of throttle opening degree adjustment by the operation of the fine adjustment switch is set, the larger the operation amount of the operation lever becomes.

14. The marine vessel according to claim 1, wherein the fine adjustment switch is provided near the operation lever.

15. The marine vessel according to claim 1, further comprising a notification unit arranged to notify the marine vessel operator of the operation state of the fine adjustment switch.

16. The marine vessel according to claim 1, further comprising a notification unit arranged to notify the marine vessel operator that the fine adjustment switch is operated.

17. A marine vessel comprising:

a hull;

a propulsion device arranged to propel the hull by a driving force of an engine including a throttle valve arranged to be electrically controlled so as to open and close;

an operation lever arranged to be operated by a marine vessel operator to adjust a throttle opening degree of the throttle valve, the operation lever arranged to hold an operation position;

a fine adjustment switch arranged to be operated by the marine vessel operator to increase or decrease the throttle opening degree, which has been adjusted by the operation of the operation lever, to further adjust the throttle opening degree that has been adjusted by the operation lever; and a control unit arranged to adjust the throttle opening degree based on an operation amount of the operation lever and an operation state of the fine adjustment switch; wherein the control unit is arranged to perform control of adjusting the throttle opening degree based on the operation state of the fine adjustment switch in addition to the operation amount of the operation lever when the operation amount of the operation lever becomes not less than a predetermined first threshold and an engine speed becomes not less than a rotational speed at which a state in which the hull travels by plowing through water transitions to a planing state in which the hull travels by riding on a surface of the water, the first threshold corresponding to the throttle opening degree at a point of transition from the state in which the hull travels by plowing through the water to the planing state in which the hull travels by riding on the surface of the water.

18. A marine vessel comprising:

a hull;

a propulsion device arranged to propel the hull by a driving force of an engine including a throttle valve arranged to be electrically controlled so as to open and close;

an operation lever arranged to be operated by a marine vessel operator to adjust a throttle opening degree of the throttle valve, the operation lever arranged to hold an operation position;

a fine adjustment switch arranged to be operated by the marine vessel operator to increase or decrease the throttle opening degree, which has been adjusted by the operation of the operation lever, to further adjust the throttle opening degree that has been adjusted by the operation lever; and a control unit arranged to adjust the throttle opening degree based on an operation amount of the operation lever and an operation state of the fine adjustment switch; wherein the control unit is arranged to perform control of adjusting the throttle opening degree based on the operation state of the fine adjustment switch in addition to the operation amount of the operation lever when the operation amount of the operation lever becomes not less than a predetermined first threshold;

the control unit is arranged to stop control by the fine adjustment switch when, in a state in which control by the fine adjustment switch is being performed, the operation amount of the operation lever falls below a second threshold less than the first threshold; and a width of throttle opening degree adjustment by the fine adjustment switch decreases as the operation amount of the operation lever approaches the second threshold from the first threshold, and at the second threshold, the width of throttle opening degree adjustment by the fine adjustment switch becomes substantially zero.

* * * * *